US009642449B2

(12) United States Patent
Hagiwara

(10) Patent No.: US 9,642,449 B2
(45) Date of Patent: May 9, 2017

(54) PAINT-COATING BRUSH AND COATING PROCESS

(71) Applicant: Toshio Hagiwara, Tokyo (JP)

(72) Inventor: Toshio Hagiwara, Tokyo (JP)

(73) Assignee: Kabushikigaisha Kabegamikakumei, Tokyo (JP)

( * ) Notice: Subject to any disclaimer, the term of this patent is extended or adjusted under 35 U.S.C. 154(b) by 30 days.

(21) Appl. No.: 13/732,087

(22) Filed: Dec. 31, 2012

(65) Prior Publication Data

US 2014/0186539 A1 Jul. 3, 2014

(51) Int. Cl.
*A46B 9/08* (2006.01)
*B05D 1/28* (2006.01)

(52) U.S. Cl.
CPC ..... *A46B 9/08* (2013.01); *A46B 2200/202* (2013.01); *B05D 1/28* (2013.01)

(58) Field of Classification Search
CPC ..... A46B 9/08; A46B 2200/202; B05D 1/28; B05C 17/10
USPC ..... 15/143.1, 159.1, 171, 174, 184, 193, 15/207.2, 208, 209.1, 166, 167.3
See application file for complete search history.

(56) References Cited

U.S. PATENT DOCUMENTS

| | | | | | |
|---|---|---|---|---|---|
| 702,998 | A | * | 6/1902 | Randolph | 15/115 |
| 1,760,614 | A | * | 5/1930 | Weintraub | 15/115 |
| 2,591,331 | A | * | 4/1952 | Baumbach | 15/160 |
| 2,703,899 | A | * | 3/1955 | Bledsoe | 15/160 |
| 3,056,987 | A | * | 10/1962 | Rifkin et al. | 15/210.1 |
| 3,722,019 | A | * | 3/1973 | Magnien | 15/114 |
| 4,391,013 | A | * | 7/1983 | Janssen | B05C 17/10 15/105.5 |
| 4,479,277 | A | * | 10/1984 | Gilman et al. | 15/111 |
| 4,730,949 | A | * | 3/1988 | Wilson | 401/132 |
| 5,072,481 | A | * | 12/1991 | Weyer | 15/167.2 |
| 5,442,829 | A | * | 8/1995 | Summers | 15/106 |
| 5,443,533 | A | * | 8/1995 | Magnien | 15/210.1 |
| 5,487,397 | A | * | 1/1996 | Bean | 134/6 |
| 5,579,720 | A | * | 12/1996 | Udelle et al. | 119/621 |
| 5,755,183 | A | * | 5/1998 | Udelle et al. | 119/622 |
| 5,933,905 | A | * | 8/1999 | Hess | 15/160 |

(Continued)

FOREIGN PATENT DOCUMENTS

| | | | |
|---|---|---|---|
| DE | 102004012376 | A1 * | 9/2005 |
| JP | A-2004-298858 | | 10/2004 |

OTHER PUBLICATIONS

Jul. 1, 2014 Office Action issued in Japanese Patent Application No. 2010-152151 (with partial English Translation).

*Primary Examiner* — Michael Jennings
(74) *Attorney, Agent, or Firm* — Oliff PLC

(57) ABSTRACT

The present invention relates to a paint-coating brush consisting of a rectangular flat body plate, a handle installed on a center of an upper surface of the body plate, and a plurality of bristles bundled on a lower surface of the body plate, wherein a front end portion of the said plate is bended downward to form a sharp R-shaped muzzle section. The procedures of using the paint-coating brush include: (A) dipping the plurality of bristles in paint; (B) using a front end (tip) portion of the body plate to contact a borderline of a target object and then coating towards a central part of the object being painted. However, the procedure of masking non-coating areas is not included.

6 Claims, 2 Drawing Sheets

(56) References Cited

U.S. PATENT DOCUMENTS

| | | | | |
|---|---|---|---|---|
| 5,983,431 | A * | 11/1999 | Meshulam | E04H 4/1609 114/222 |
| D519,282 | S * | 4/2006 | Clark et al. | D4/137 |
| 8,480,325 | B2 * | 7/2013 | Gallardo | 401/188 R |
| 8,881,684 | B1 * | 11/2014 | Yazdanpanah | 119/650 |
| 8,990,988 | B2 * | 3/2015 | Robbins et al. | 7/113 |
| 2003/0156884 | A1 * | 8/2003 | Teh | 401/39 |
| 2004/0111817 | A1 * | 6/2004 | Chen | A47L 13/16 15/104.94 |
| 2004/0255427 | A1 * | 12/2004 | Gavney, Jr. | 15/401 |
| 2006/0207042 | A1 * | 9/2006 | Di Paolo | 15/111 |
| 2011/0225755 | A1 * | 9/2011 | Carlson et al. | 15/145 |

* cited by examiner

PAINT-COATING BRUSH AND COATING PROCESS

BACKGROUND OF THE INVENTION

1. Field of the Invention

This invention relates to a paint-coating brush and its coating process, particularly to a paint-coating brush and a coating process that avoids the time-consuming work of masking non-coating areas.

2. Description of Related Art

Paint-coating is quite necessary for both internal and external appearances of constructions. Whether doing multicolor coatings or fashion coatings, operators have to mask off areas that are not to be painted, such as window frames and built in electronic outlets, with masking tapes before starting the painting process, so as to ensure that non-coating areas are not contaminated. However, such a process consumes much more time than that required by the coating work proper, and also wastes lots of masking tapes. Besides, the used masking tapes left after the coating work also produce large quantity of wastage.

Accordingly, a conventional paint-coating brush as shown in FIG. 3 has an end of a body plate extending downward at a right angle, and its bristles do not contact with the non-coating areas. But the borderlines between coating and non-coating areas will be left as uncoated strips, which have to be painted with a small-sized brush later. Such a coating process is time-consuming and residual spots will make the coating seem unfinished.

Furthermore, the paint-coating brush as shown in FIG. 3 adopts bristles of pad painters, and part of the paint brush is specifically for non-coating areas. With a baffle installed sideways and the special part for non-coating areas, when paint-coating is being done no paint will be attached to non-coating areas, and no subsequent repair work is needed. [Reference Cited 1] JP, 2004-298858, A (FIG. 1)

SUMMARY OF THE INVENTION

The present invention relates to a paint-coating brush consisting of a rectangular flat body plate, a handle installed on a center of an upper surface of the body plate, and a plurality of bristles bundled on a lower surface of the body plate, wherein a front end portion of the said plate is bended downward to form a sharp R-shaped muzzle section.

The procedures of using the paint-coating brush include: (A) dipping the plurality of bristles in paint; (B) using a front end (tip) portion of the body plate to contact a borderline of a target object and then coating towards a central part of the object being painted. However, the procedure of masking non-coating areas is not included.

Nevertheless, the brush (foam) shown in Reference Cited 1 adopts sponges, wherein the peripheral regions of the foam are sealed and a baffle is installed sideling. Thus even though coating work starts after a front end portion of the baffle contacts with a borderline between coating and non-coating areas, spots may be left near the borderline, which isn't a pretty sight.

The present invention discloses a solution to the above-mentioned problems after a thorough analysis. A paint-coating brush according to the present invention consists of a rectangular flat body plate, a handle mounted on a center of an upper surface of the body plate, and a plurality of bristles bundled in a lower surface of the body plate, wherein a front end portion of the body plate is bended downward to form a sharp R-shaped muzzle section. The procedures of using the paint-coating brush include: (A) dipping the plurality of bristles in paint; (B) using a sharp front end portion of the body plate to contact a borderline of the target object, and then coating towards a central part of a coating area. However, the procedures of masking non-coating areas are not included.

The paint-coating brush and the coating process in the present invention effectively reduce time and labor that are originally spent in masking off non-coating areas as well as the wastage of masking materials. In this regard, the product is said to be highly efficient and useful.

DETAILED DESCRIPTION OF THE PREFERRED EMBODIMENTS

Figure 1:
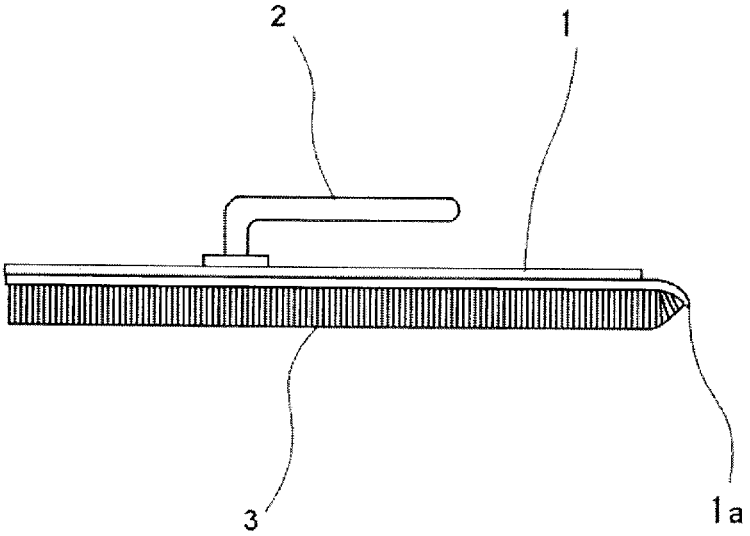
FIG. 1 is a side view of a preferred embodiment of the present invention.
Figure 2:
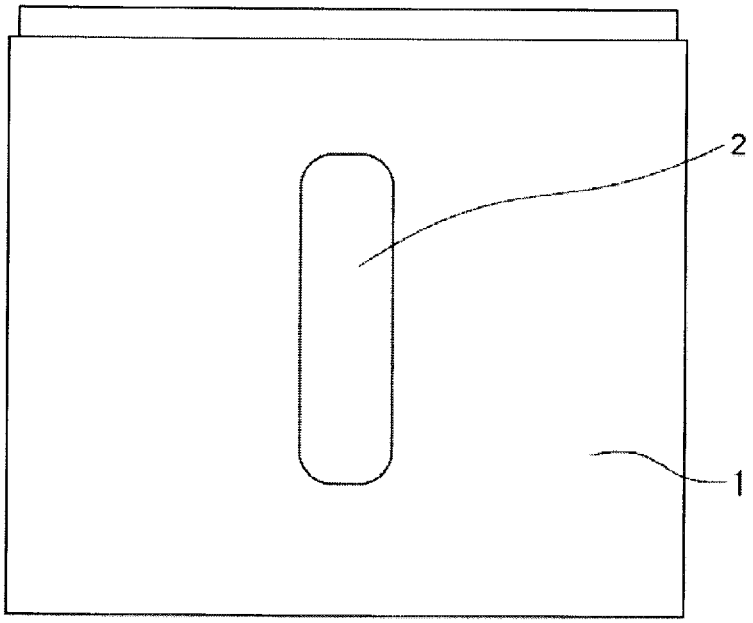
FIG. 2 is a plan view of a preferred embodiment of the present invention.
Figure 3:
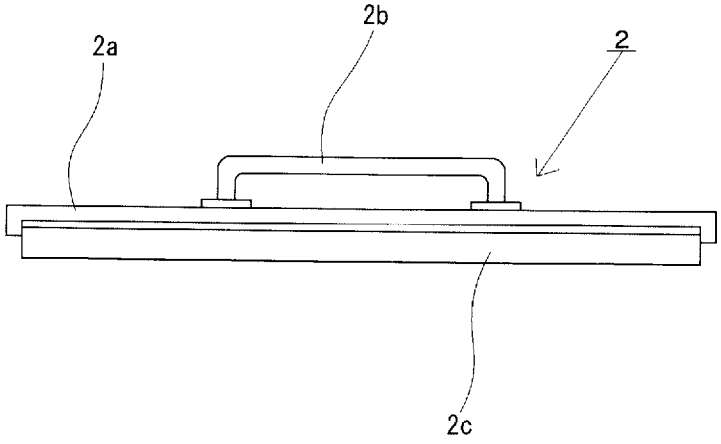
FIG. 3 is a side view of a conventional paint-coating brush.

The following explains an embodiment of the present invention in detail in line with the drawings, in which FIG. 1 is a side view of a preferred embodiment of the present invention; FIG. 2 is a plane view of a preferred embodiment of the present invention; FIG. 3 is a side view of a conventional paint-coating brush.

The present invention particularly relates to a paint-coating brush and its coating process that avoids the work of masking off non-coating areas, which is the most time-consuming in a coating operation. The first embodiment described in the invented product relates to a paint-coating brush consisting of a rectangular flat body plate 1, a handle 2 mounted on a center of an upper surface of the body plate 1, and a plurality of bristles 3 bundled in a lower surface of the body plate 1, wherein a front end portion la of the body plate 1 is bended downward to form a sharp R-shaped muzzle section.

The second embodiment described in the invented product relates to a coating process involving the use of a paint-coating brush with a rectangular flat body plate 1, wherein a handle 2 is installed on a center of an upper surface of the body plate 1 and a plurality of bristles 3 are bundled in a lower surface of the body plate 1. The features of the paint-coating brush lie in the design of bending a front end portion la of the body plate 1 to form a sharp R-shaped muzzle section. The procedures of using the paint-coating brush include dipping the plurality of bristles 3 in paint, using a front end portion (tip) la of the body plate 1 to contact a borderline of a target object, arid then coating towards a central part of a coating area. The procedures of masking non-coating areas are excluded.

The invented product, scilicet, is a paint-coating brush as shown in FIGS. 1 and 2, which consists of a rectangular flat body plate 1 made of resin, an L-shaped handle 2 mounted on a center of an upper surface of the body plate 1, and a plurality of bristles 3 bundled in holes on nearly a whole lower surface of the body plate 1. Moreover, a front end portion (tip) 1*a* of the body plate 1 is bended downward to form a sharp R-shaped muzzle section. Coating is conducted in the following procedures. The steps for coating with the paint-coating brush are described below: hold the handle 2 mounted on an upper surface of the body plate 1 with one hand to dip the plurality of bristles 3 bundled in a lower surface of the body plate 1 into paint.

After dipping the plurality of bristles 3 in paint, use a front end portion (tip) 1*a* of the body plate 1 to contact a borderline between coating and non-coating areas and then coat towards a central part of a coating area. The coating processes in the present invention do not include procedures of masking off non-coating areas. Therefore paint won't be attached in non-coating areas even without doing masking work. Operators can paint evenly from a borderline between coating and non-coating areas towards a center of a coating area. The masking procedures for non-coating areas are eliminated, and thus the present invention can help save time and labor spent on masking work as required by conventional paint-coating brushes and their coating processes.

What is claimed is:

1. A paint-coating brush, comprising:

a rectangular flat body plate having an upper surface and a lower surface opposite to said upper surface;

a front end portion being an edge of said body plate;

a handle mounted on a center of said upper surface of said body plate; and a plurality of bristles directly and downwardly extending from said lower surface of said body plate and configured to carry paint for painting;

wherein:

said handle is L-shaped and has a vertical portion which is fixed to said upper surface of said body plate at an end thereof and extends in a direction substantially perpendicular to said body plate, and a horizontal portion which extends substantially horizontally from an opposite end of said vertical portion in a direction moving toward said front end portion, said horizontal portion is spaced apart from and substantially in parallel with said body plate, free edges of said plurality of bristles define a surface, said front end portion of said body plate is sharpened and curved downwardly in an arc relative to said body plate in a direction moving away from the horizontal portion of the handle and toward said surface so as to form a curved portion, at least a part of said plurality of bristles is located on said curved portion, and said surface defined by said plurality of bristles that are located on said curved portion is tilted with regard to said surface defined by said plurality of bristles that are located outside said curved portion, wherein said at least a part of said plurality of bristles that is located on said curved portion is shorter than said plurality of bristles other than said at least a part of said plurality of bristles that is located on said curved portion, and wherein the bristles of said plurality of bristles that are located on said curved portion become progressively shorter in a direction from the bristle on said curved portion closest to said plurality of bristles that are located outside said curved portion to the bristle on said curved portion farthest from said plurality of bristles that are located, outside said curved portion.

2. The paint-coating brush according to claim 1, wherein said plurality of bristles that are located on said curved portion are arranged within an area of said curved portion.

3. The paint-coating brush according to claim 1, wherein said surface of said plurality of bristles that are located outside said curved portion is linear.

4. The paint-coating brush according to claim 1, wherein said rectangular flat body plate defines a first horizontal plane, said front end portion is curved downwardly from the first horizontal plane in a direction away from the first horizontal plane and away from the horizontal portion of the handle, toward said surface defined by said plurality of bristles.

5. The paint-coating brush according to claim 1, wherein said paint-coating brush is configured such that when said front end portion of said body plate moves from a borderline between a coating area and a non-coating area toward a central part of said coating area, the non-coating area remains free of paint even when said area is not masked.

6. The paint-coating brush according to claim 1, wherein all the bristles extend directly and downwardly from said lower surface of said body plate.

* * * * *